United States Patent [19]

Todd

[11] 3,932,999

[45] Jan. 20, 1976

[54] PILE DRIVING

[75] Inventor: George Stewart Todd, Thames Ditton, England

[73] Assignee: Taylor Woodrow International Ltd., London, England

[22] Filed: Nov. 15, 1974

[21] Appl. No.: 524,276

[30] Foreign Application Priority Data

Nov. 16, 1973 United Kingdom ..... 53425/73

[52] U.S. Cl. ..... 61/53.5; 173/139

[51] Int. Cl.[2] ..... E02D 7/00

[58] Field of Search ..... 61/53.5, 53.7, 53.52; 173/139, DIG. 2

[56] References Cited

UNITED STATES PATENTS

| | | | |
|---|---|---|---|
| 2,128,742 | 8/1938 | Fuehrer | 173/DIG. 2 |
| 3,499,497 | 3/1970 | Moore | 61/53.5 X |

FOREIGN PATENTS OR APPLICATIONS

| | | | |
|---|---|---|---|
| 576,236 | 3/1946 | United Kingdom | 61/53.52 |

*Primary Examiner*—Jacob Shapiro
*Attorney, Agent, or Firm*—Waters, Schwartz & Nissen

[57] ABSTRACT

Driving hollow piles by utilising a hollow drive tube inserted in the tube and applying hammer blows to an abutment at the bottom of this tube.

6 Claims, 2 Drawing Figures

PILE DRIVING

This invention relates to pile driving.

Traditionally load bearing piles have been installed by driving them from the top with some type of hammer acting upon the protected head of the pile to apply a downward pressure. In its simplest form the hammer consists of a mass of cast iron or steel which is raised above the head of the pile and allowed to drop onto the head under its own weight, although this simple drop hammer has been replaced to a large extent by more sophisticated steam, compressed air or diesel driven hammers having, of course, advantages especially in certain applications, but suffering from the disadvantages of complexity and higher cost as compared with simpler equipment. There is, furthermore, a major problem that is always encountered where piles are driven by striking their heads, and that is the considerable noise that occurs. It is the principal object of the present invention to provide a method of driving hollow piles with a minimum of noise.

According to one aspect of the present invention there is provided a methods of driving hollow piles, comprising driving such a pile by applying blows to an abutment of a hollow drive tube, the abutment being remote from one end of the tube and the tube extending down the pile so that said abutment is within the pile, the force of blows so applied being transferred to the pile via a further abutment of the hollow tube that is adjacent said one end.

According to a second aspect of the present invention there is provided a method of erecting a piling structure utilising hollow piles, comprising driving such a pile by applying blows to an abutment of a hollow drive tube, the abutment being remote from one end of the tube and the tube extending down the pile so that said abutment is within the pile, the force of blows so applied being transferred to the pile via a further abutment of the hollow tube that is adjacent said one end, and driving subsequent piles in similar manner to form the desired piling structure.

According to a third aspect of the present invention there is provided piling structure erected by the methods just defined.

Since, in the methods as just defined, the blows are applied within the pile, the sound emanating therefrom is muffled, and hence the noise of driving the pile is minimised.

For a better understanding of the invention and to show how the same may be carried into effect, reference will now be made, by way of example, to the accompanying drawing, in which.

Figure 1:
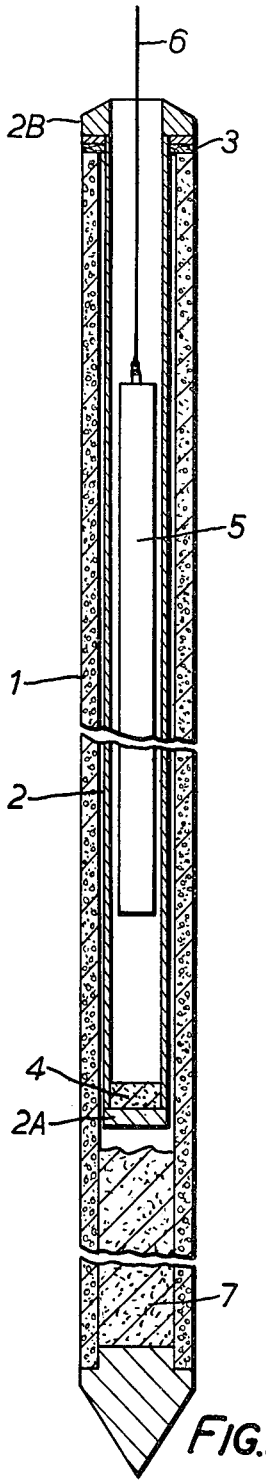
FIG. 1 illustrates a method of driving a hollow concrete pile.

Referring first to FIG. 1, the pile 1 is a conventional full-length hollow concrete pile formed, for example, by the spinning process. In order to drive this pile to form part of a piling structure, it is placed in position for driving and a hollow steel drive tube 2 is inserted in the pile. This tube 2 is closed at the end that is inserted into the pile by a wall 2A constituting an abutment of the tube. This wall 2A is sufficiently strong to withstand the blows that are applied to it during driving as described below. The tube 2 is of an external diameter such that it can be readily inserted in, and subsequently removed from, the pile 1, the tube 2 having a collar 2B adjacent its end remote from the wall 2A that is of sufficient diameter that it may rest on the top rim of the pile. This collar 2B, which constitutes a further abutment of the tube 2, serves during driving to transfer to the pile the force of blows applied to the wall 2A, the collar being of suitable strength.

Preferably cushioning material in the form of circular packing 3 is positioned between the collar 2B and the upper rim of the pile; further cushioning material, in the form of, for example, sand 4, being placed in the bottom of the tube 2.

Driving is effected utilising a steel hammer 5 constiting of a long weight of such a section that it can be lowered into the drive tube 2 with sufficient clearance for easy movement up and down in the tube, and to permit free movement of air in order to avoid any "piston" effect. The hammer 5 is lowered from a lifting appliance (not shown) via a rope 6.

The sequence of operations to effect driving is as follows:

A. The pile to be driven is held in position by a supporting frame.

B. Cushioning material (the packing 3) is placed on the rim of the pile.

C. The drive tube 2 is inserted so that its collar 2B rests upon the cushioning material.

D. Cushioning material (the sand 4) is placed in the bottom of the drive tube 2.

E. The hammer 5 is inserted into the drive tube 2 until its lower end rests upon the cushioning material at the bottom of the drive tube 2.

F. The hammer 5 is raised by the lifting equipment and released to fall freely under its own weight. The energy of the blow is transmitted through the cushioning material at the bottom of the tube 2 to the closed end of the tube, then through the walls of the tube to the collar 2B and the cushioning material under the collar to the top of the pile itself thus causing a downward pressure on the pile. This process is repeated until driving is completed.

G. The hammer 5 is removed.

H. The drive tube 2 is removed.

I. The cushioning material formed by the packing 3 is removed from the head of the pile.

Preferably, prior to inserting the drive tube 2, the pile is filled with sand 7 to just below the closed end of the tube 2 so that should the hammer break through the end of the tube 2 (for example, through being dropped from too great a height) its fall is arrested by the sand 7.

The above sequence of operations is effected with subsequent piles to complete the desired piling structure.

Figure 2:
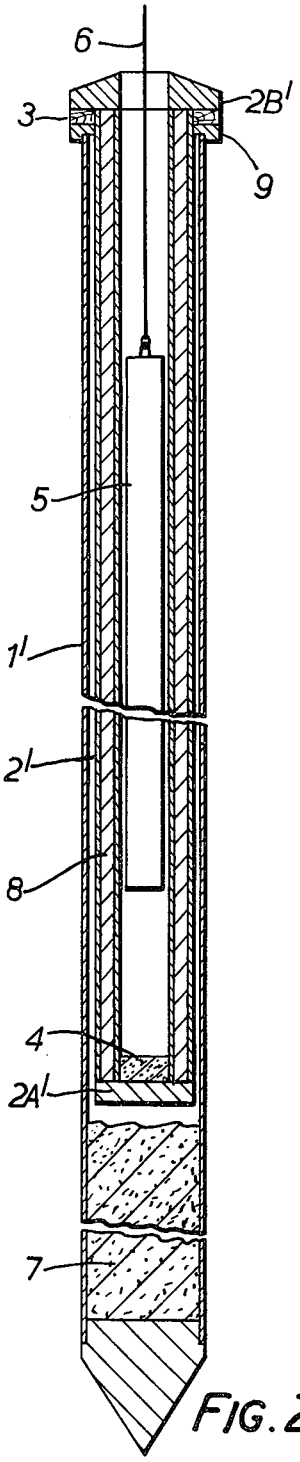
FIG. 2 illustrates a method of driving a hollow steel pile.

Referring to FIG. 2, the method utilised for driving hollow steel piles such as the pile 1′ shown therein is substantially as described above. However, whereas the thickness of a concrete pile is such as effectively to muffle the sound of the hammer blows, to achieve maximum muffling when driving a steel pile the drive tube 2′ utilised is a double walled tube having sound insulation material 8 between its two walls. Furthermore, to provide sufficient area for the packing 3 to seat on at the top of the pile, a steel helmet 9 is mounted on the upper rim of the pile.

It will be appreciated that, in the method of pile driving that has been described, the hammer blows are applied some way down the pile and hence the sound thereof is effectively muffled. As the force of the blows is transferred to the top of the pile, the pile does not have to be constructed in any special way to withstand the blows, and the pile is not tensioned by the blows which is particularly important in the case of a concrete pile. The steel drive tube is reusable and the equipment required for applying the blows is of the simplest kind.

I claim:

1. A method driving hollow piles, comprising driving such a pile by applying blows to a first abutment of a hollow drive tube, said first abutment being remote from one end of the tube, said tube having a second abutment remote from said one end, said tube extending down the pile so that said first abutment is within the pile and spaced from the bottom of the pile so that the force of applied blows is transferred to the pile via said second abutment.

2. A method driving hollow piles according to claim 1, and comprising positioning cushioning material between said second abutment and the pile.

3. A method of driving hollow piles according to claim 1, and comprising placing cushioning material to receive the blows applied to said first abutment.

4. A method of driving hollow piles according to claim 1, wherein the hollow drive tube utilised is double walled and has sound insulation material between its walls.

5. A method of erecting a piling structure with hollow piles, comprising driving such a pile by applying blows to a first abutment of a hollow drive tube, said first abutment being remote from one end of the tube, said tube having a second abutment adjacent said one end, said tube extending down the pile so that said first abutment is within the pile and spaced from the bottom of the pile so that the force of applied blows is transferred to the pile via said second abutment, and driving subsequent piles in similar manner to form the desired piling structure.

6. A method of erecting a piling structure according to claim 5 and comprising holding a first pile to be driven in position; placing cushioning material so as to be positioned between said second abutment and the pile; inserting the drive tube into the pile so that said second abutment rests on this cushioning material; placing further cushioning material in the drive tube to receive the blows to be applied to said first abutment; inserting a hammer in the drive tube until it rests on the last-mentioned cushioning material; repeatedly raising the hammer and letting it fall freely under its own weight until driving of the pile is completed; removing the hammer; removing the drive tube; removing the first-mentioned cushioning material; and repeating said steps with further piles.

* * * * *